US005588323A

United States Patent [19]

Peterson

[11] Patent Number: 5,588,323

[45] Date of Patent: Dec. 31, 1996

[54] HAND-HELD RIVET BUCKING TOOL USING ENERGY DISSIPATIVE POLYMER

[75] Inventor: Craig Peterson, Milford, Mich.

[73] Assignee: U.S. Industrial Tool and Supply, Plymouth, Mich.

[21] Appl. No.: 447,198

[22] Filed: May 22, 1995

[51] Int. Cl.[6] ..... B21J 9/18

[52] U.S. Cl. ..... 72/465; 29/243.53

[58] Field of Search ..... 72/465, 478, 482, 72/453.13; 29/243.53, 243.54

[56] References Cited

U.S. PATENT DOCUMENTS

| | | | |
|---|---|---|---|
| 2,290,256 | 7/1942 | Souter | 121/21 |
| 2,349,341 | 5/1944 | Disse | 78/53 |
| 2,899,934 | 5/1959 | Salengro | 121/13 |
| 3,696,501 | 10/1972 | Burtin | 29/509 |
| 3,747,194 | 7/1973 | Christensen | 72/465 |
| 4,218,911 | 8/1980 | Johnston | 72/465 |
| 4,380,923 | 4/1983 | Emmerich | 72/482 |
| 4,398,411 | 8/1983 | Emmerich | 72/482 |
| 4,723,610 | 2/1988 | Dummermuth | 173/1 |
| 5,269,381 | 12/1993 | Oscarson | 173/162 |

FOREIGN PATENT DOCUMENTS

| | | | |
|---|---|---|---|
| 0157716 | 6/1989 | Japan | 72/465 |
| 1286340 | 1/1987 | U.S.S.R. | 72/465 |
| 1433629 | 10/1988 | U.S.S.R. | 72/465 |
| 1449231 | 1/1989 | U.S.S.R. | 72/465 |

*Primary Examiner*—Daniel C. Crane
*Assistant Examiner*—Ed Tolan
*Attorney, Agent, or Firm*—Gifford, Krass, Groh, Sprinkle, Patmore, Anderson & Citkowski

[57] ABSTRACT

The present invention relates to a hand held rivet bucking tool having a vibration dampening assembly including a visco-elastic polymer. The bucking tool features a dolly disposed within a housing and a vibration dampening assembly disposed therebetween. The visco-elastic polymer portion of the vibration dampening assembly absorbs and dissipates the vibration energy resulting from impacts received and delivered by the dolly. A second embodiment of the invention features a quick change dolly which can readily be removed from the housing so that a particular dolly can be used in conjunction with a particular rivet to be installed.

6 Claims, 3 Drawing Sheets

A-A

HAND-HELD RIVET BUCKING TOOL USING ENERGY DISSIPATIVE POLYMER

FIELD OF THE INVENTION

The present invention relates generally to vibration dampening in conjunction with tool usage and, more particularly, to a hand-held rivet bucking tool or "bar " which uses a visco-elastic polymer to dissipate at least a portion of the impact energy received.

BACKGROUND OF THE INVENTION

A vibration-damped hand-held rivet bucking tool currently exists in the art, as evidenced by U.S. Pat. No. 5,269,381. In this design, a vibration exposed inertia member is telescopically received by a cup-shaped grip element so as to allow axial reciprocal movement of the inertia member in relation to the grip element during use of the tool. Between the grip element and the inertia member there is provided a vibration damping system having two springs which are pre-tensioned between the grip element and the inertia member in opposite directions to obtain a balanced neutral position therebetween. When the relative position between these two elements is changed due to vibration forces, the springs act to regain the neutral position. The grip element and the inertia member have circular cross sections and are rotationally interlocked by a key.

This design presents certain drawbacks, however. First, the use of two counteracting springs results in a large number of components which must be manufactured with tight tolerances. Second, a central rod is used to hold the various components together internally, and this central rod is secured to the grip element by means of a screw, precluding straight-forward replacement or swapping of the rivet engaging implement formed on one end of the inertia member. If one or more of the springs could be replaced by an improved energy dissipation system, a simpler design should result and, at the same time, facilitate a quick-change of the rivet engaging implement or "dolly."

SUMMARY OF THE INVENTION

An object of the present invention is to provide a hand-held portable bucking tool having a housing with an interior chamber which receives an impact-receiving shank and a vibration dampening means which includes an energy dissipative polymer to absorb and dissipate at Least a portion of the vibration energy associated with the impact received. In one embodiment, the energy dissipative polymer may simply be compressed by the impact-receiving shank, however, in the preferred embodiment, a portion of the shank internal to the housing narrows to a rod-shaped element smaller in diameter than the shank itself, and the polymer material surrounds the rod at its distal end, and is bonded thereto, enabling the shank and rod to reciprocate axially by a small degree as each impact is received, transferring a portion of the associated energy to the polymer, which converts that energy into heat. Preferably, the outer surface of the polymer surrounding the rod at its distal end is further bonded to a cylindrical casing slidably received within a cylindrical bore associated with the housing, enabling the polymer material so encased to slide within the housing, in addition to enabling the shank and rod to reciprocate within the surrounding polymer. The preferred embodiment further includes a spring disposed between the distal end of the shank rod with the encased polymer and the terminal end of the bore within the housing, resulting in a two-piece piston assembly to convert and dissipate any energy over wider range of impacts.

A second object of the present invention is to provide a readily replaceable impact receiving member or "dolly". The dolly can be readily removed and replaced by rotating and removing the dolly from the housing. The dolly is retained in place by a plurality of ball bearings which engage a plurality of longitudinal grooves formed in the housing.

DETAILED DESCRIPTION OF THE PREFERRED EMBODIMENT

Figures 1, 2, 3:
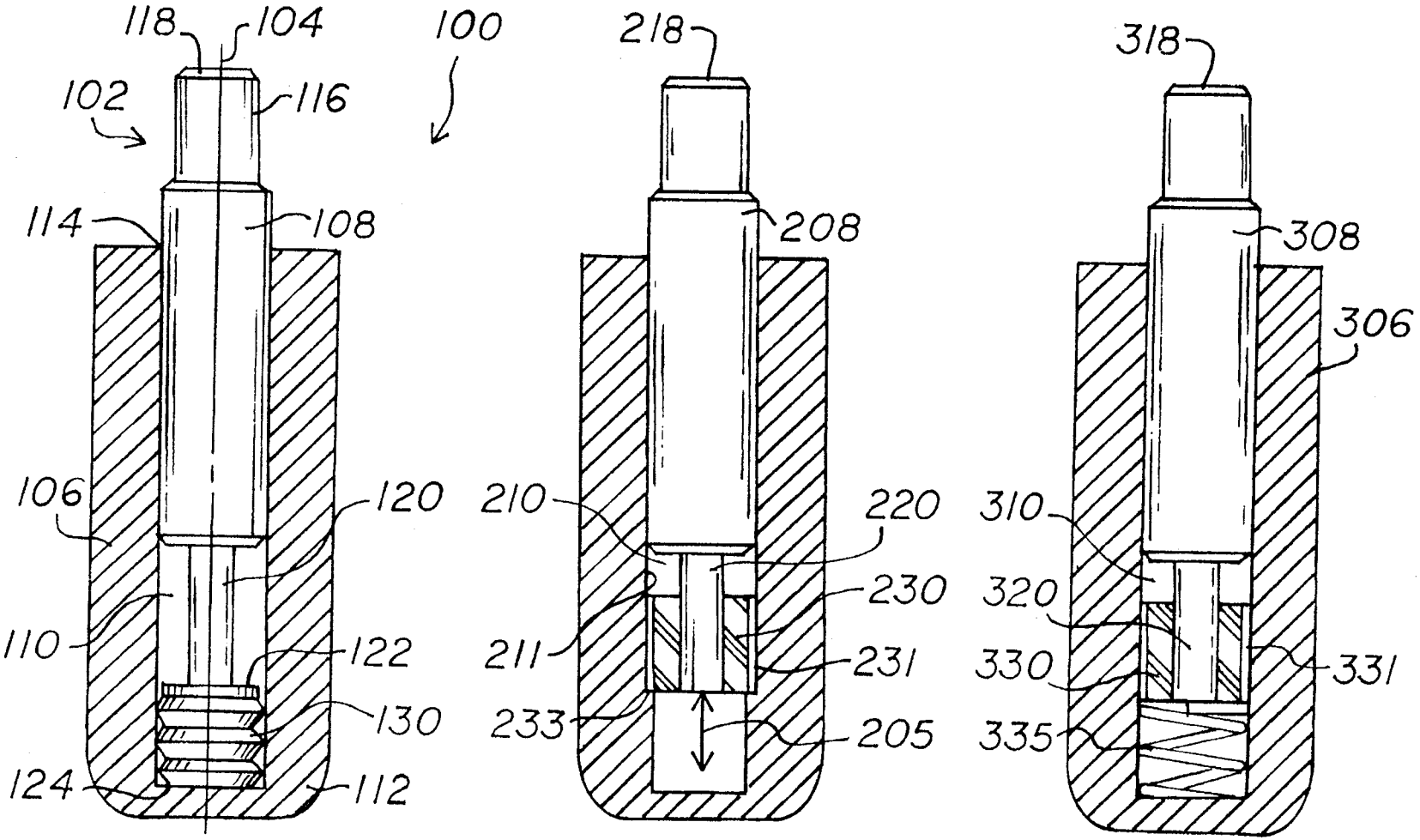
FIG. 1 is a drawing in partial cross section of a hand-held rivet bucking tool wherein a dolly shank is configured so as to compress an energy dissipative polymer.
FIG. 2 is an alternative embodiment of a hand-held rivet bucking tool according to the invention, wherein an energy dissipative polymer surrounds a shank movable with respect there.
FIG. 3 is yet a further alternative embodiment of the invention, wherein an energy dissipative polymer surrounds a movable shank portion, and further including a spring configured as part of a two-part piston assembly.

FIG. 1 shows generally at 100 a first embodiment of a hand-held rivet bucking tool or "bucking bar" according to the invention. An impact receiving member 102 or "dolly" includes a shank 108 slidably received along an axis 104 within a housing 106. The housing 106 has an interior chamber 110 adapted to receive the dolly shank 108 and a closed rounded outer end 112 opposite the chamber opening 114 adapted to easily fit into the palm of a user's hand. The dolly 102 has an impact receiving end 116 having an impact receiving surface 118 which is shaped according to the type of work being done. The impact receiving surface 118 can further be provided with a coating to inhibit wear.

Within the interior chamber 110, the shank 108 preferably narrows to a rod portion 120 connected to a plate 122. Between this plate 122 and the interior surface 124 opposite the opening 114 there is disposed a slug of an energy dissipative polymer, preferably of the visco-elastic type. Such polymeric material is commercially available, though other sources may alternatively be used or become available. In the configuration of FIG. 1, this polymeric material is disposed within a bellows 130, comprising a thin, outer metallic shell, though plastics and other materials may alternatively be used for this purpose. As the surface 118 experiences vibrational impacts during use, the energy is transmitted through the slidable shank portion 108, through rod 120 and plate 122, causing a compression of the polymeric material. Compression of this polymeric material is such that vibration energy received is at least partially converted into heat, which may be absorbed by the housing 106 and radiated from its outer surfaces. Although the shank portion 108 may be constructed as a solid unit having the plate 122 integrally formed therewith in unitary fashion, the rod 120 is preferably instead utilized so that at least a portion of the heat generated by the material 130 may be contained within chamber 110 as well as radiated from the outer surface of the housing 106.

FIG. 2 is a side-view drawing representative of an alternative embodiment of the invention, wherein, instead of compressing the energy-dissipative polymer, such material is supported around a rod portion 220 enabling a greater movement of the shank 208, and a greater dissipation of the energy through the polymeric medium 230, in this case shown in cross section. In addition to being bonded angularly around the rod 220, an outer cylindrical casing 231 is further bonded around the outer portion of the material 230, not only to contain the material 230, but also to provide some degree of slidability between the casing 231 and the inner wall 211 of the interior volume 210. In the configuration of FIG. 2, an annular step 233 is provided at the distal end of the inner chamber restricting further distally extensive motion of the encased polymeric material 230, thereby enabling the rod 220 to readily assume an axially oriented reciprocating motion, as indicated by the arrow 205 as the surface 218 receives an impact.

FIG. 3 shows yet a further alternative embodiment of the invention, in this case replacing step 233 of FIG. 2 with a spring 335, resulting in a two-part piston-type of assembly within the chamber 310. Now, as surface 318 receives an impact, causing shank portion 308 to slide relative to the housing 306, two stages of energy dissipation occur, the first being the movement of rod 320 relative to the casing 331, as its axial motion is restricted to a certain degree by the spring 335. However, with a sufficiently strong impact, spring 335 compresses in addition to the movement of rod 310 within polymeric material 330, resulting in a two-part energy dissipation system.

Figure 4:
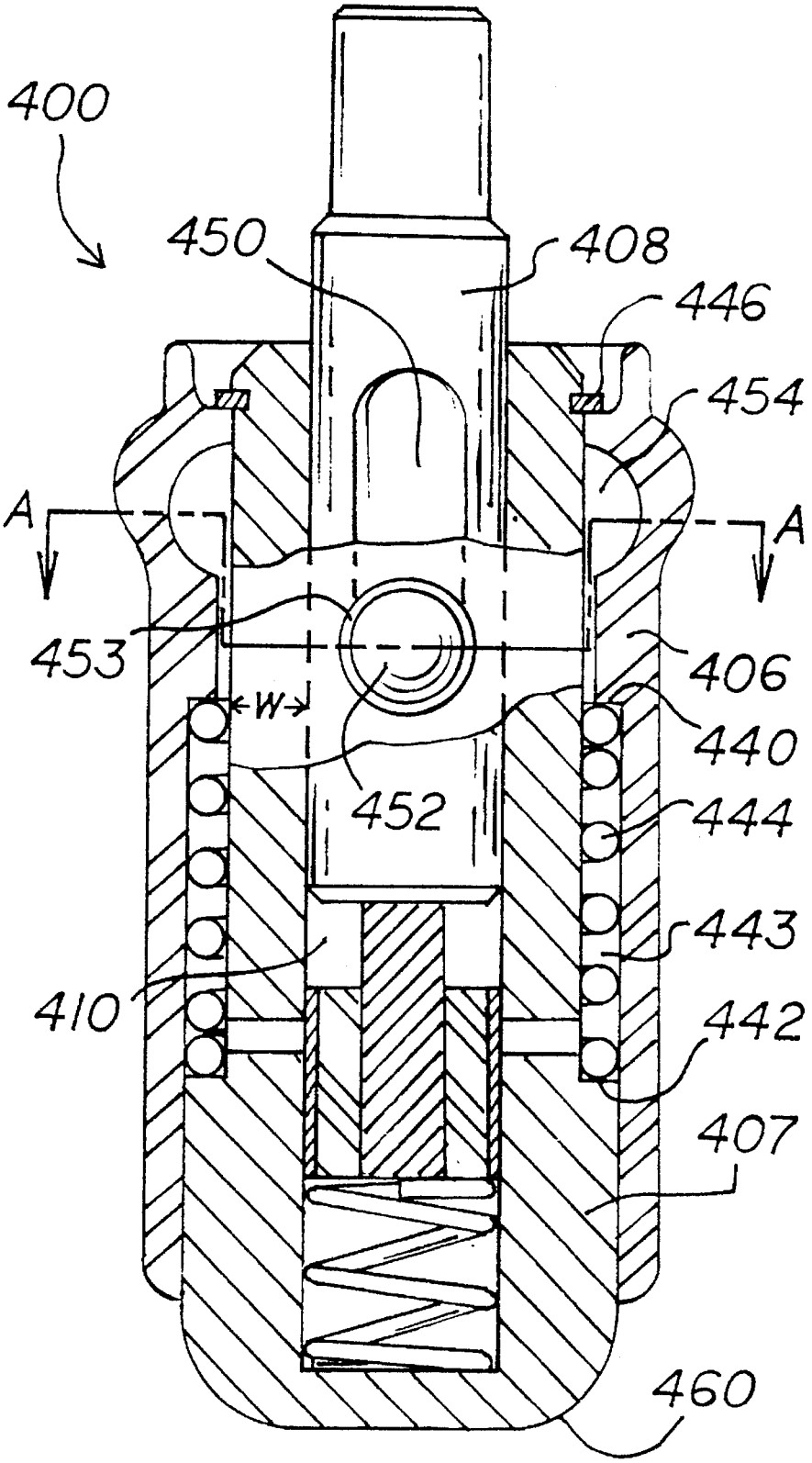
FIG. 4 is a side-view drawing in partial cross section incorporating the embodiment of FIG. 3, but further including a quick-change dolly capability.

FIG. 4 illustrates generally at 400 yet another, further alternative embodiment of the invention, including the two-part piston-type energy dissipation system of FIG. 3, but further including quick-change dolly assembly. In the preferred embodiment, this quick-change assembly is facilitated by splitting the outer housing into two portions, an outer body portion 406, and an inner sleeve portion 407, the two portions being slidable with respect to one another, though with the extent of such motion being constrained and controlled in the following manner. An annular lip 440 is formed as shown on the inner wall of the outer housing member 406, and a corresponding lip 442 is formed as shown on the outer surface of the inner housing portion 407, resulting in two circularly shaped opposing surfaces at either end of a cylindrically shaped chamber 443. Within this chamber 443 there is placed a spring 444 which urges the surfaces 440 and 442 apart, but with the extent of this separation being maintained by an annular ring 446 formed in a groove 447 of the inner housing portion 407, such that as spring 444 forces the surfaces 440 and 442 apart, an outwardly extending portion of this ring 446 is caught by an annular portion of the outer housing 406, thus restricting any further extent of the sliding motion between the two housing bodies. With a sufficiently strong spring 444, these bodies 406 and 407 are biased apart to an extent sufficient to cause the two housing portions to behave as a unitary structure during use for rivet impact bucking.

Making further reference to FIG. 4, an annular groove 454 having a hemispherically shaped inner wall is now included around an inner section of the outer housing body 406, as shown, and one or more longitudinal grooves 450, also preferably including a hemispherically shaped surface, are formed along a portion of the shank 408 the extent of one such longitudinal slot 450 being evident in FIG. 4. In addition, a ball bearing 452 is provided in conjunction with each longitudinal groove 450 formed along the shank portion 408, each ball bearing 452 residing in a cavity formed radially outward from the longitudinal axis of the tool and through the body of the inner housing member 407 as aperture 453. Thus, in FIG. 4, the aperture 453 would be formed through the body of member 407 in a manner projecting outwardly from the drawing sheet. The width W of the wall of the body of the inner housing member 407 is such that with this spring 444 biasing the two housing components apart to their fullest extent as shown, the ball 452 is held in a more or less stationary position, but with tolerances allowing the shank portion 408 to reciprocate axially, at least to the extent of the longitudinal groove 450. Regardless of the impact motion, however, the shank 408 is effectively stopped at the longitudinal extent of the groove 450.

However, should a dolly change be in order, with pressure applied to the externally exposed surface 460 of the inner sleeve portion 407, compressing spring 444, the apertures formed through the body of the inner housing component 407 may, with sufficient pressure, be brought into alignment with the annular groove 454, enabling the balls 452 to move radially outward with respect to the longitudinal axis of the tool, so that, when fully received by the annular groove 454, all portions of each ball "clear" the non-longitudinally grooved sections of the shank 408, enabling the shank 408 to be slid outwardly from the bore of the inner housing component 407, thereby effectuating a change in the dolly portion of the tool.

Figure 5:
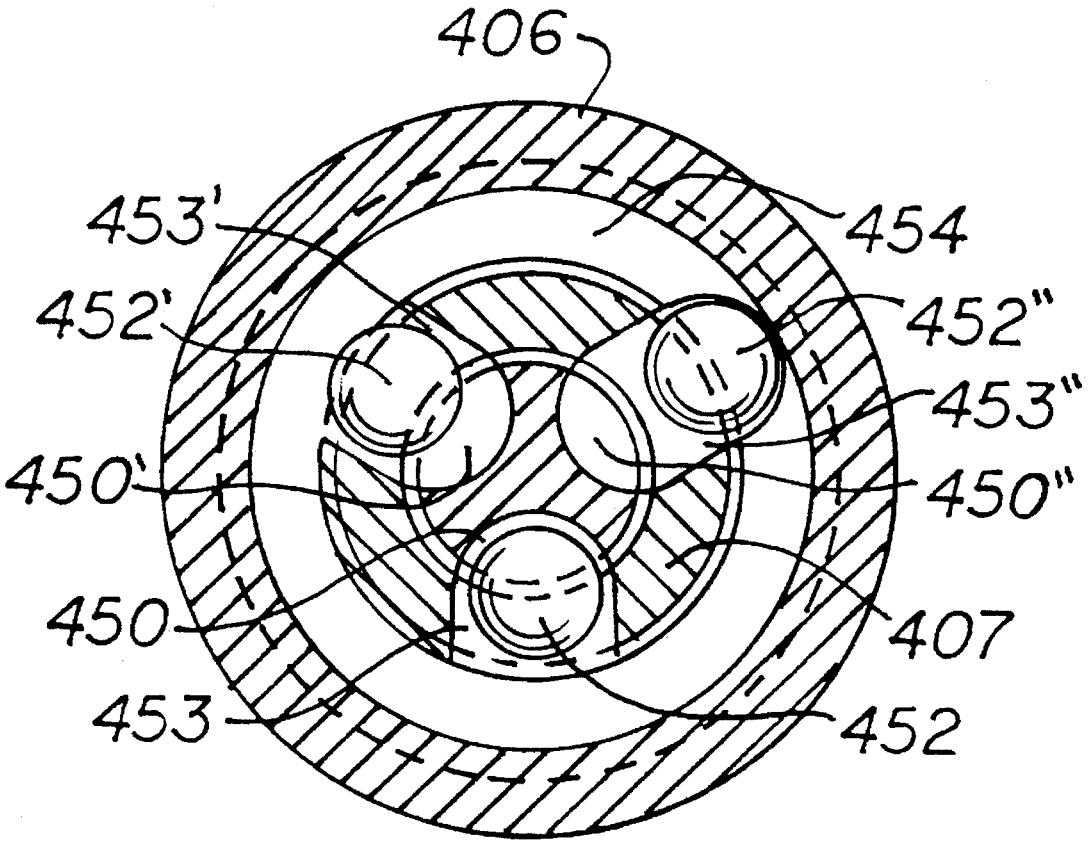
FIG. 5 shows a cross section of the tool of FIG. 4 taken along lines A—A.

FIG. 5 is a cross section of the tool of FIG. 4, taken along lines A—A, which would illustrate the situation with the spring 444 being compressed, so that the balls may be received by annular groove 454. FIG. 5 illustrates the preferred embodiment of having three equally spaced apart grooves 450, 450' and 450", each with an associated ball 452, 452' and 452", respectively. Thus, three apertures are formed radially outwardly and through the body of the inner housing component 407, these being 453,453' and 453".

FIG. 5 also shows each ball bearing being in a different stage in terms of leaving its associated longitudinal groove to be received by the annular groove 454. That is, in the case of ball 452, although it could under the circumstances shown roll into the annular groove portion 454 and thus clear the non-grooved portions of the shank 408, in this case it is illustrated as remaining proximate to is respective longitudinal groove. Ball 452', on the other hand, has rolled partially out of its respective longitudinal groove 450', but not yet into the annular groove 454, and its thus straddling a position between the two grooves. Ball 452", however, has rolled entirely out of its respective groove 450", and has been received along its outer surface to the fullest possible extent by the annular groove 454, such that the innermost point of the ball 450" now fully clears all portions of the shank 408, including outer non-longitudinally grooved portions of the shank. Accordingly, if all balls 452, 452' and 452" are configured radially outwardly to their fullest possible extent as in the case of ball 452", all portions of the shank will clear their respective balls and the shank may be pulled out or out of the drawing of FIG. 5 for replacement or maintenance purposes.

Having thus described my invention, I claim:

1. A bucking tool, comprising:

a housing having an interior chamber;

an impact receiving member slidably received in said interior cavity, said member having a first end with an externally exposed impact-receiving surface and a second end terminating in a stem within said cavity; and a cylindrical mass of visco-elastic energy dissipative polymer bonded around said stem, said mass defining an outer surface and circular edge oriented in opposed relation from said impact-receiving surface, said edge being retained within said interior cavity, causing said stem to move within and stretch polymer as to dissipate at least a portion of the vibration energy associated with an impact received by said member.

2. A bucking tool as defined in claim 1, wherein said impact receiving member is removably retained within said interior chamber.

3. The bucking tool as defined in claim 1, further including a rigid casing bonded to the outer surface of said cylindrical mass of energy dissipative polymer.

4. The bucking tool as defined in claim 1 wherein said vibration dampening assembly further comprises a spring for absorbing at least a portion of the vibration energy not absorbed by said polymer.

5. The bucking tool as claimed in claim 2, further comprising an outer sleeve removably interlocked to said housing.

6. The bucking tool as claimed in claim 5, further comprising:

an outer spring supported between said sleeve and said housing, said impact receiving member further comprising a plurality of longitudinal depressions formed on said outer surface;

said housing further comprising a plurality of apertures along the circumference thereof adapted to be aligned with said plurality of longitudinal depressions;

a plurality of ball bearings disposed within each of said apertures and within said longitudinal depressions, such that when said impact receiving member is depressed and rotated, at least one of said plurality of ball bearings is dislodged, thereby releasing said impact receiving member from said housing.

* * * * *